United States Patent [19]

Novak

[11] 4,424,077

[45] Jan. 3, 1984

[54] PROTECTIVE FILM FOR METALLIC ARTICLES

[75] Inventor: Miroslav Novak, Prague, Czechoslovakia

[73] Assignee: Statni vyzkumny ustav materialu, Prague, Czechoslovakia

[21] Appl. No.: 410,071

[22] Filed: Aug. 20, 1982

[30] Foreign Application Priority Data

Aug. 20, 1981 [CS] Czechoslovakia ..... 6226-81

[51] Int. Cl.[3] ..... C09D 5/38

[52] U.S. Cl. ..... 106/290; 106/300; 106/308 B

[58] Field of Search ..... 106/290, 300, 308 B

[56] References Cited

U.S. PATENT DOCUMENTS 2,845,660 8/1958 Peiler ..... 106/290

*Primary Examiner*—James Poer

[57] ABSTRACT

A protective film for metallic articles against penetration of nitrogen, carbon and boron at chemical-heat treatment by means of glow discharge plasma at a temperature ranging from 450° to 950° C.

A protective coating is formed on the metallic article by a dispersed mixture of tin and lead absorbed on titanium dioxide containing 35 to 60% by weight of colloidally dispersed tin, 5 to 10% by weight of colloidally dispersed lead, 10 to 23% by weight of titanium dioxide, 5 to 10% by weight of a binding agent such as methyl methacrylate, and the remainder up to 100% by weight is an organic solvent such as toluene, xylene, and ethyl acetate. The mixture is used as a protective coating against penetration of nitrogen, carbon and boron at a chemical-heat treatment by means of a glow discharge plasma at a temperature range from 450° to 950° C.

3 Claims, No Drawings

PROTECTIVE FILM FOR METALLIC ARTICLES

BACKGROUND OF THE INVENTION

The present invention relates to a protective film for metallic articles to provide a barrier against penetration of nitrogen, carbon and boron during chemical-heat-treatment in glow discharge plasma at temperatures ranging from 450° to 950° C.

Ionic nitriding, carbonitriding and boroning is carried out in a vacuum container having a vacuum-tight cover in which articles are disposed for chemical-heat-treatment. The container is connected as an anode and the articles are connected as a cathode to an electrical power source. Ionic diffusive processes are realized at anomalous glow discharge which is determined by high current density and high voltage. Glow discharge is an areolar passage of direct current between anode and cathode in gases having reduced pressure. It is produced by dissociation of molecules into ions which act as electric current carriers under the action of voltage differential between anode and cathode. Either pure nitrogen or a mixture of nitrogen and hydrogen formed by ammonia dissociation is employed as nitrogen carriers at ionic nitriding. Gaseous hydrocarbons, for example methane, are still added at ionic carbonitriding. Hydrogen with diborane or boron trifluoride are used at ionic boroning.

Positive ions originate from molecules of the individual gaseous elements such as hydrogen, nitrogen and similar substances, which ions pass from anode to cathode, so that at sufficiently high input voltage there results a multiplication of ions and as a result there is also formed the so-called plasma owing to interaction with molecules of the gaseous phase. At impingement of positive ions onto the cathode their kinetic energy is transformed to heat and due to that the surface of articles is heated. Ion impact results further in release of electrons which emit radiation inducing a luminous crown at ionically nitrided, carbonitrided and boroned articles.

At ionic nitriding, carbonitriding and boroning certain places of the chemical-heat-treated articles have to be protected from nitrogen, carbon and boron penetration.

At the present time cap nuts, cups and similar articles are employed as a protection wherever this is possible because the glow discharge is effective only at the exposed surface and it does not penetrate into gaps.

Protection with electrodeposited coatings of copper, nickel or tin is the second method used. This method is complex, pretentious, and costly insofar as handling and hygiene is concerned. Formation of intermetallic compounds of tin and iron which are fragile manifests itself as a drawback of tinning in some cases as well.

There are known also other methods of protection. Protective coating containing fine copper powder or tungsten trioxide with baking varnish is one example of such known methods. The coatings presented protect insufficiently mainly at the cutting edges of threads.

SUMMARY OF THE INVENTION

The drawbacks mentioned are eliminated by a protective film of metallic materials according to the invention, the subject matter of which is the use of the mixture of colloidally dispersed tin and lead absorbed on titanium dioxide containing 35 to 60% by weight of colloidally dispersed lead, 10 to 23% by weight of titanium dioxide, 5 to 10% by weight of a binding agent such as polybutyl methacrylate, methyl methacrylate and the remainder up to 100% by weight is an organic solvent such as toluene, xylene, ethyl acetate, which mixture is used as a protective film against penetration of nitrogen, carbon and boron in the glow discharge plasma at temperatures ranging from 450° to 950° C.

The presented mixture according to the invention forms a thin layer at the surface of metallic articles which layer reliably prevents the penetration of nitrogen, carbon and boron.

Protective filming according to the invention can be realized by the dipping of parts to be protected or by paint application.

The effective thickness of protective layer is 0.1 to 0.5 mm after drying. After chemical-heat treatment of parts in glow discharge plasma the protective layer can be easily removed for example with a steel brush.

Several examples of the application of the present invention are set forth below. It will be appreciated by those skilled in the art that these examples are solely for purposes of exposition and are not to be construed as limiting.

EXAMPLE 1

An ionic nitriding at a temperature range of 450° to 550° C. is carried out. A colloidally dispersed mixture of tin and lead absorbed on titanium dioxide is used containing:

50 to 60% by weight of colloidally dispersed tin
5 to 7% by weight of colloidally dispersed lead
10 to 15% by weight of titanium dioxide
8 to 10% by weight of polybutyl methacrylate
8 to 27% by weight of toluene

EXAMPLE 2

An ionic carbonitriding at a temperature range of 550° to 700° C. is carried out.

The following is used:

40 to 55% by weight of colloidally dispersed tin
8 to 10% by weight of colloidally dispersed lead
15 to 20% by weight of titanium dioxide
5 to 8% by weight of methyl methacrylate
7 to 32% by weight of ethyl acetate

EXAMPLE 3

An ionic boroning at a temperature range of 800° to 950° C. is carried out.

The following is used:

35 to 50% by weight of colloidally dispersed tin
5 to 7% by weight of colloidally dispersed lead
18 to 23% by weight of titanium dioxide
7 to 10% by weight of methyl methacrylate
10 to 35% by weight of xylene

What is claimed is:

1. A protective film for metallic articles, used as a protective coating against penetration of nitrogen, carbon and boron at a chemical-heat treatment by means of glow discharge plasma at a temperature ranging from 450° to 950° C., consisting of a colloidally dispersed mixture of tin and lead absorbed on titanium dioxide containing 35 to 60% by weight of colloidally dispersed tin, 5 to 10% by weight of colloidally dispersed lead, 10 to 23% by weight of titanium dioxide, 5 to 10% by weight of a binding agent, and the remainder is an organic solvent.

2. The protective film for metallic articles as set forth in claim 1, wherein said binding agent is selected from the group of binding agents consisting of polybutyl methatrylate and methyl methacrylate.

3. The protective film for metallic articles as set forth in claim 1, wherein said solvent is selected from the group of solvents consisting of ethyl acetate, toluene and xylene.

* * * * *